US005172816A

United States Patent [19]

Kline et al.

[11] Patent Number: 5,172,816

[45] Date of Patent: Dec. 22, 1992

[54] SHOE RACK

[75] Inventors: Richard B. Kline; Chris Serslev, both of Overland Park, Kans.; Vijay S. Malik, Kansas City, Mo.

[73] Assignee: Lynk, Inc., Shawnee Mission, Kans.

[21] Appl. No.: 819,111

[22] Filed: Jan. 10, 1992

[51] Int. Cl.[5] ..... A47F 7/08

[52] U.S. Cl. ..... 211/37; 211/194

[58] Field of Search ..... 211/34, 35, 36, 37, 211/38, 188, 194

[56] References Cited

U.S. PATENT DOCUMENTS

| | | | |
|---|---|---|---|
| D. 85,502 | 11/1931 | Wilhem | 211/37 X |
| 790,669 | 5/1905 | Winship | 211/37 |
| 873,496 | 10/1907 | Bryant | 211/188 |
| 2,152,192 | 3/1939 | Hoffman | 211/34 |
| 2,276,141 | 3/1942 | Atkinson | 211/37 |
| 2,506,844 | 5/1950 | Smith . | |
| 3,468,426 | 9/1969 | Loewy | 211/35 |
| 3,695,190 | 10/1972 | Bucholz . | |
| 3,888,353 | 6/1975 | Leifheit | 211/37 |
| 4,673,092 | 6/1987 | Lamson et al. . | |
| 4,819,814 | 4/1989 | Fogelgren | 211/194 X |
| 4,940,150 | 10/1990 | Spengler . | |

*Primary Examiner*—Ramon O. Ramirez

*Attorney, Agent, or Firm*—Kokjer, Kircher, Bowman & Johnson

[57] ABSTRACT

A modular shoe rack consisting of a pair of rods extending between, and supported by, a pair of side frames. The side frames are generally rectangular in configuration and are identical in construction. Each side frame includes a groove arrangement in the bottom and a mating tongue arrangement at the top such that plural side frames may be stacked one upon the other in a stable manner. Each side frame also includes a receiving hole at each side thereof sized to receive the rods. As such, the rods may be inserted within the receiving holes of two side frames to define a shoe rack of single unit length. Thereafter, an additional pair of rods may be inserted into the receiving holes on an opposite side of one of the previous side frames, and a third side frame connected to the free ends of these additional rods. With this arrangement, a shoe rack having two units length is provided by using only three side frames, thus saving the material employed to form a fourth side frame, which would be required using prior art devices. The elongated structure is also formed as a single unit which is more structurally sound and aesthetically pleasing than a pair of prior art devices.

11 Claims, 1 Drawing Sheet

SHOE RACK

BACKGROUND OF THE INVENTION

1. Field of the Invention

The present invention relates in general to racks for storing shoes. In particular, the present invention relates to an improved shoe rack of a modular nature for expansion of storage capacity.

2. Description of the Related Art

Numerous types of racks for the storage of shoes and footwear have been known for many years. It has also been known to provide shoe racks with adjustment and interlocking features for improved versatility.

For example, Atkinson U.S. Pat. No. 2,276,141 shows a shoe rack having a pair of rods extending between side frames. The rods are telescopic such that the storage capacity of the shoe rack may be expanded, or the shoe rack may be fit to a particular closet size. Another example is Leifheit U.S. Pat. No. 3,888,353. This reference discloses a shoe rack having telescopic rods extending between a pair of side frames as in the previous patent, but additionally includes interlocking features such that multiple shoe racks may be placed one in front of the other to provide additional storage depth, or additional shoe racks may be stacked one upon the other to provide additional storage height.

SUMMARY OF THE INVENTION

An object of the present invention is to provide a shoe rack having modular elements for ease of storage expansion.

Another object of the present invention is to provide a space saving modular shoe rack having interlocking features such that multiple shoe racks may be stacked one upon another.

Yet another object of the present invention in which additional modular elements may be added to increase the length of the shoe rack with minimal use of materials. These and other objects are achieved by a modular shoe rack consisting of a pair of rods extending between, and supported by, a pair of side frames. The side frames are generally rectangular in configuration and are identical in construction. Each side frame includes a groove arrangement in the bottom and a mating tongue arrangement at the top such that plural side frames may be stacked one upon the other in a stable manner. Each side frame also includes a receiving hole at each side thereof sized to receive the rods. As such, the rods may be inserted within the receiving holes of two side frames to define a shoe rack of single unit length. Thereafter, an additional pair of rods may be inserted into the receiving holes on an opposite side of one of the previous side frames, and a third side frame connected to the free ends of these additional rods. With this arrangement, a shoe rack having two units length is provided by using only three side frames, thus saving the material employed to form a fourth side frame, which would be required using prior art devices. The elongated structure is also formed as a single unit which is more structurally sound and aesthetically pleasing than a pair of prior art devices.

BRIEF DESCRIPTION OF THE DRAWINGS

The objects and features of the invention noted above ar explained in more detail with reference to the drawings in which like reference numerals denote like elements, and in which.

DETAILED DESCRIPTION OF THE INVENTION

Figure 1:
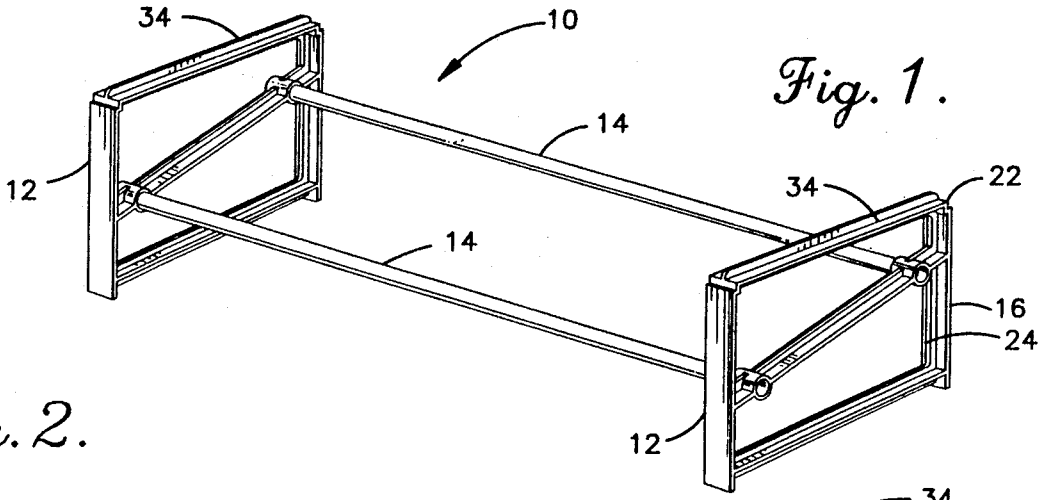
FIG. 1 is a perspective view of a shoe rack according to the present invention.

With reference to FIG. 1, a single unit shoe rack according to the present invention is generally designated by reference numeral 10. Each single unit 10 generally consists of a pair of side frames 12 which support a pair of support tubes 14.

Each of the side frames 12 is substantially identical and has a generally rectangular configuration. Specifically, each side frame 12 includes a pair of spaced upwardly extending struts 16 which are maintained in position by an upper cross bar 18 connected to the upper end of each strut 16 and a lower cross bar 20 extending between the struts 16 at a position adjacent to the lower ends of the struts.

Figure 2:
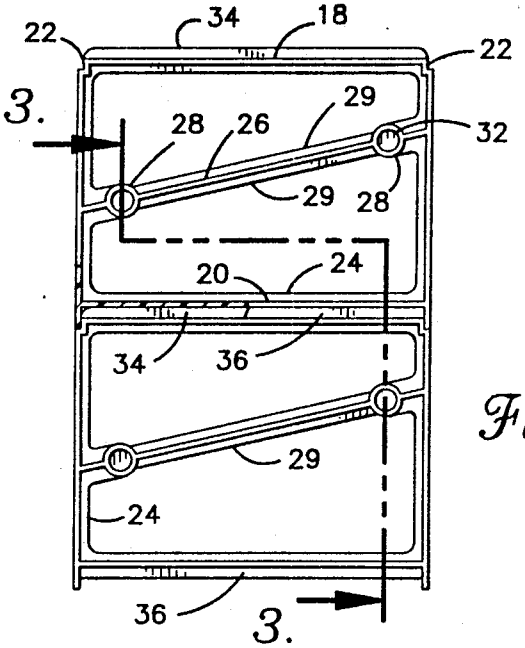
FIG. 2 is a side view of stacked side frames according to the present invention.
Figure 4:
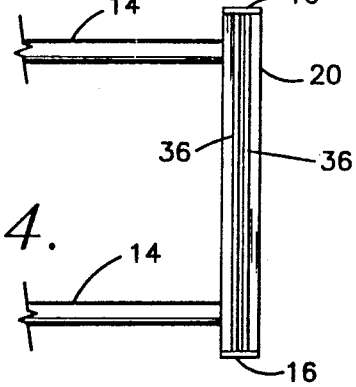
FIG. 4 is a bottom view of the shoe rack of FIG. 1.

The upper end of each strut 16 includes an inwardly projecting shoulder 22. While the shoulders 22 could be formed as an indentation within the strut 16, it is preferred that the struts 16 are of a relatively small depth (approximately ⅛ inch) as shown in FIG. 2. As such, the shoulder 22 may be formed as a dog leg in the upper end of the struts 16. As noted above, the upper cross bar 18 will extend between the struts 16 at the portion containing the shoulder 22 such that the upper cross bar 18 has a length less than the lower cross bar 20.

The struts 16 and cross bars 18 and 20 may be formed of separate elements which are connected together by adhesives, welding or other known means. However, it is preferred for strength and economy that these elements be formed as monolithic units by plastic molding. Where such plastic material is employed, it may be necessary to form an inwardly extending reinforcing rib 24 which extends along each of the members 16 through 20 to encompass the entire interior periphery of the rectangular shape of the side frame 12.

A support bar 26 extends between the struts 16 at a position intermediate the cross bars 18 and 20. The support bar 26 mounts a pair of tube supports 28. While the tube supports may take many configurations, in the present invention it is preferred that the supports 28 take the form of cylindrical holes which have a diameter sized to frictionally retain the support tubes 14 therein.

Figure 3:
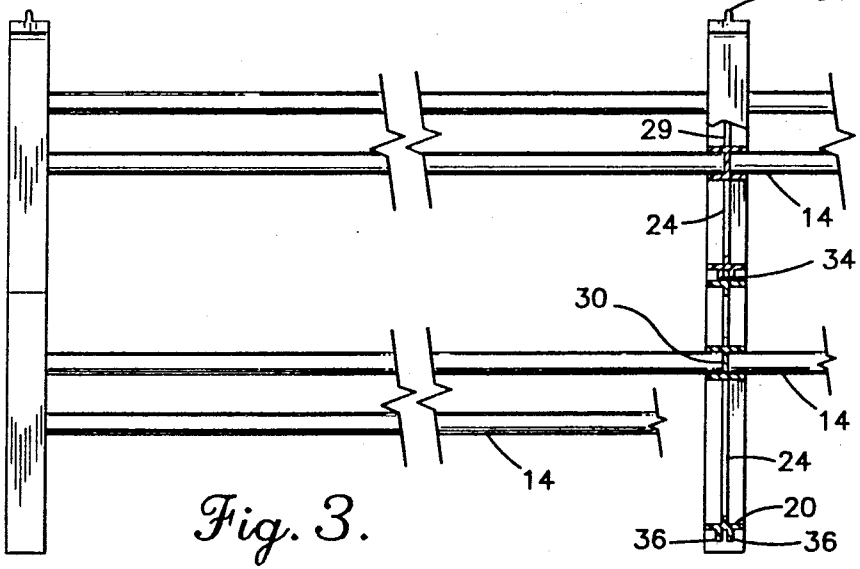
FIG. 3 is a front view showing the modular nature of the present shoe rack; :nd

As is best shown in FIG. 3, each of the cylindrical holes which define the tube support 28 include a centrally located dividing wall 30. As such, each of the tube supports 28 include and define a pair of cylindrical cavities 32 which each open outwardly from the plane defined by the struts 16 and cross bars 18 and 20. These cavities 32 will receive the ends of the support tubes 14, with the end of the support tube abutting the dividing wall 30, as best shown in FIG. 3. This abutment will allow the user to readily place the tubes in the cavities to the proper depth. In a manner similar to the struts and cross bars, it may be necessary to provide the support bar 26 with a centrally disposed and vertically extending reinforcement rib 29. For added strength, this reinforcement rib may extend from both the top and bottom face of the support bar 26.

The support tubes 14 which extend between the side frames 12 are preferably formed of steel, aluminum, or other metal sheeting rolled into a tubular form. This will provide sufficient strength to support several pairs of shoes. As shown in the figures, the support bar 26 is preferably formed at an angle with respect to horizontal such that one of the support tubes 14 is higher than the other. This will allow the higher of the support tubes to support the shoe just forward of the heel, with the toe of the shoe, or at least a forward portion thereof, supported by the lower of the support tubes. As such, the single unit 10 shown in FIG. 1 will provide a stable structure for supporting several pairs of shoes.

For additional storage capacity in a lateral direction, an additional pair of support tubes 14 may be inserted into the outwardly opening cylindrical cavities 32 of one of the side frames 12. A third side frame would then be mounted to the free end of these additional support tubes to define a shoe rack which is two units long. It should be noted, and is an important aspect of the present invention, that while such a shoe rack would be two units long, only three of the side frames 12 need be employed. This will save materials and thus cost for the user. Additionally, the extended shoe rack will be a single integral unit having greater structural stability and aesthetic appeal than simply two single units placed side by side.

It is to be understood that additional support tubes 14 could be inserted into the outwardly opening cavities 32 of this third side frame, or the other of the original side frames, and a further side frame 12 attached thereto to further enlarge the lateral length of the shoe rack, with there being no limit to such lateral extension. In general terms, for each unit length n, the number of side frames necessary will be $n+1$, rather than $2n$ for multiple discrete prior art units, thus saving greater amounts of material with greater length.

The side frames according to the present invention are also provided with interlocking structure such that the shoe racks may be stacked one upon the other in a stable manner to provide further storage capacity.

In particular, the upper cross bar 18 includes a centrally located and upwardly extending interlock rib 34. Rib 34 extends the full length of the upper cross bar 18 as shown in the accompanying figures. Alternatively, the interlock rib 34 may be formed as a plurality of members having lesser length, such as a pair of ribs spaced along the length of the cross bar 18.

Extending downwardly from the lower cross bar 20 are a pair of guide ribs 36. The ribs 36 are substantially centrally located and are spaced from each other so as to receive the interlock rib 34 of a side frame 12 upon which it is stacked. As is best seen from a comparison of FIGS. 2 and 3, the free end of the guide end 36 is spaced upwardly from the lower ends of the struts 16. The extent of this upward spacing substantially corresponds to the depth of the shoulders 22 formed in the struts 16. As such, when the interlock rib 34 is received within the guide ribs 36, the lower ends of the struts 16 may be received within the shoulders 22 of a lower side frame 12.

In this manner, a stable interlock arrangement is provided such that side frames 12 of units 10 may be stacked one upon the other. Specifically, the arrangement of the interlock rib 34 and guide ribs 36 will prevent movement of the side frames in a lateral direction. Additionally, the engagement of the lower portion of the struts 16 with the shoulders 22 will prevent relative movement in a front to rear direction. This will substantially eliminate the possibility of accidental displacement of the stacked side frames, with this interlocking arrangement being enhanced by the placement of shoes upon the upper of unit 10.

From the above description it may be seen that the modular shoe rack according to the present invention provides utility to the user. As a single unit the rack provides stable storage for shoes and footwear. Additionally, the rack may be expanded laterally in a manner which is structurally sound, reduces material costs and saves space. Further, the arrangement provides for lateral expansion in a stable manner, providing yet more storage capacity.

Additional variations may be made to the present invention to make it more useful. One such variation allows use of the standard components to allow the storage of boots. The typical stacked configuration of the present units described above will have sufficient height between vertically adjacent rods for the storage of shoes, but not for boots. The boots could of course be stored on the upper one of the units 10, but this will make the boots vulnerable to being knocked over by movement of other clothing in the closet. While the length of the struts could be increased such that boots will fit between stacked units, this would result in wasted space and material when the units are employed for shoes.

To allow the storage of boots in a protected manner without wasting space or material, a pair of side frames without the usual support tubes could be placed within a stack of the units to provide the necessary space. For example, two units 10 could be stacked with one unit upon the other. A pair of side frame without the support tubes extending therebetween could then be placed on the second or upper unit 10. One or more additional units 10 would then be stacked upon the unattached side frames to complete the desired stack of units.

By this arrangement the unattached side frames will act as spacers, creating twice the usual spacing between the vertically adjacent support tube pairs which border the unattached side frames. This extra spacing between the support tube pairs provides sufficient space for boots to be stored upon the lower of these pairs, while the usual spacing between the remaining support tube pairs will allow the storage of shoes without wasted space or material.

While the particular location (i.e., bottom, next to bottom, etc.) of the unit 10 supporting the unattached side frames is not important, it is preferred that at least one unit 10 be mounted upon the unattached side frames. This is due to the reduced stability of the unattached side frames compared to a complete unit 10, which is aggravated when the side frames are formed of a light weigh plastic. Stacking a unit 10 upon the unattached side frames lends lateral and front to back stability to the upper ends of the unattached side frames, and the added weight helps to maintain the interlocking means in position.

The unattached side frames may be provided with further stability if one or more of these side frames includes a lateral extension as discussed above. For example, a modular rack may be formed with a lower level being three units long in the lateral direction (four side frames separated by three support tube pairs). The next level could then be formed using two units 10 each having a single unit length, and stacked upon the lower level with one side frame of each unit 10 interlocking with a laterally exterior one of the side frames of the lower level. This will result in the two interior side frames of the upper or second level being unattached to each other, thus providing a sheltered space for storing boots. Of course, additional levels could be placed upon the second level for additional storage capacity. These additional levels would further stabilize the unattached side frames, although this is not believed to be necessary.

While the present invention has bee described with reference to a specific embodiment, it should be noted that various modifications may be made without departing from the spirit of the invention. For example, different materials or reinforcement rib arrangements may be employed. Additionally, the support tubes 14 need not be of a fixed length, but may be telescopic to provide further flexibility, as is known in the art.

From the foregoing it will be seen that this invention is one well adapted to attain all ends and objects hereinabove set forth together with the other advantages which ar obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative, and not in a limiting sense.

What is claimed is:

1. A modular shoe rack system, comprising:

at least one pair of support tubes; and at least two side frames, each being substantially identical and including a pair of tube supports, each of said tube supports including a pair of oppositely opening cavities, each of which is adapted to receive a respective end of one of said tubes, with a pair of said tubes extending between each adjacent pair of said frames, said tube supports being located above a lower end of said side frames whereby said support tubes are supported above the ground, and whereby one pair of said tubes may be connected to and extend between one pair of said side frames to define a single unit length rack having exterior ones of said frames, and an additional pair of said tubes may be connected to and extend between the open ones of said cavities of said exterior ones of said frames and an additional side frame to define a multiple unit rack having n units with the use of only n+1 side frames.

2. A system as in claim 1, wherein each of said side frames includes a pair of spaced substantially vertically extending struts and an upper and a lower crossbar extending between and connected to said struts to define a generally rectangular configuration, and a support bar extending between said struts at a position intermediate said cross bars, said support bar mounting said tube supports.

3. A system as in claim 2, wherein each of said side frames is formed as a monolithic unit.

4. A system as in claim 2, wherein said support bar is angled with respect to horizontal, whereby one of an associated pair of said support tubes is vertically higher than the other.

5. A system as in claim 2, wherein said upper cross bar includes an upwardly extending interlock rib, and said lower cross bar includes a pair of spaced downwardly extending guide ribs, whereby the interlock ribs of one pair of said side frames may be received between respective pairs of said guide ribs of a further pair of said side frames, allowing each said unit rack to be stacked one upon the other.

6. A system as in claim 5, wherein each of said struts includes an inwardly extending shoulder at an upper edge thereof, and said guide ribs do not extend to the lower end of said struts such that each of said struts includes a free lower end, said free lower ends of said struts adapted to mate with said shoulders, allowing each said unit rack to be stacked one upon the other.

7. A system as in claim 6, further comprising an additional pair of said side frames, each of said additional pair of said side frames being stacked upon an adjacent pair of said side frames of one of said units, said additional pair of said side frame including none of said support tubes extending therebetween, thereby providing additional space for the storage of boots.

8. A system as in claim 1, comprising three of said side frames, each adjacent pair of said frames including a pair of said support tubes extending therebetween and connected thereto, and each adjacent pair of said side frames and associated ones of said tube defining a unit rack.

9. A system as in claim 8, wherein each of said side frames includes a pair of spaced substantially vertically extending struts and an upper and a lower crossbar extending between and connected to said struts to define a generally rectangular configuration, and a support bar extending between said struts at a position intermediate said cross bars, said support bar mounting said tube supports.

10. A system as in claim 9, wherein each of said side frames is formed as a monolithic unit.

11. A system as in claim 9, wherein said support bar is angled with respect to horizontal, whereby one of an associated pair of said support tubes is vertically higher than the other.

* * * * *